US005516234A

United States Patent [19]

Duchesne

[11] Patent Number: 5,516,234

[45] Date of Patent: May 14, 1996

[54] PRESSURE COMPENSATING BUOYANCY JACKET

[76] Inventor: Claude A. Duchesne, 1051 Via Cordova, San Pedro, Calif. 90731

[21] Appl. No.: 270,476

[22] Filed: Jul. 5, 1994

[51] Int. Cl.[6] ..... B63C 11/04

[52] U.S. Cl. ..... 405/186; 2/102; 2/338

[58] Field of Search ..... 405/186; 2/102, 2/338

[56] References Cited

U.S. PATENT DOCUMENTS 1,088,285 2/1914 Kessler ..... 2/102

1,272,519 7/1918 Piper ..... 2/339

4,808,033 2/1989 Belmonte ..... 405/186

5,011,334 4/1991 Vorhaver ..... 405/186

*Primary Examiner*—David J. Bagnell

*Attorney, Agent, or Firm*—Mattthew P. Lynch

[57] ABSTRACT

An elastic apparatus to be incorporated within a buoyancy compensating jacket to be used by scuba divers which is to maintain the jacket in a tight position on the torso of the scuba diver whether the diver is submerged in the water or is out of the water. The elastic apparatus comprises a plurality of stretchable elastic strips which are either mounted in conjunction with the jacket or are mounted in conjunction with a belt which is to be worn on the outside of the jacket.

2 Claims, 1 Drawing Sheet

FIG. 1
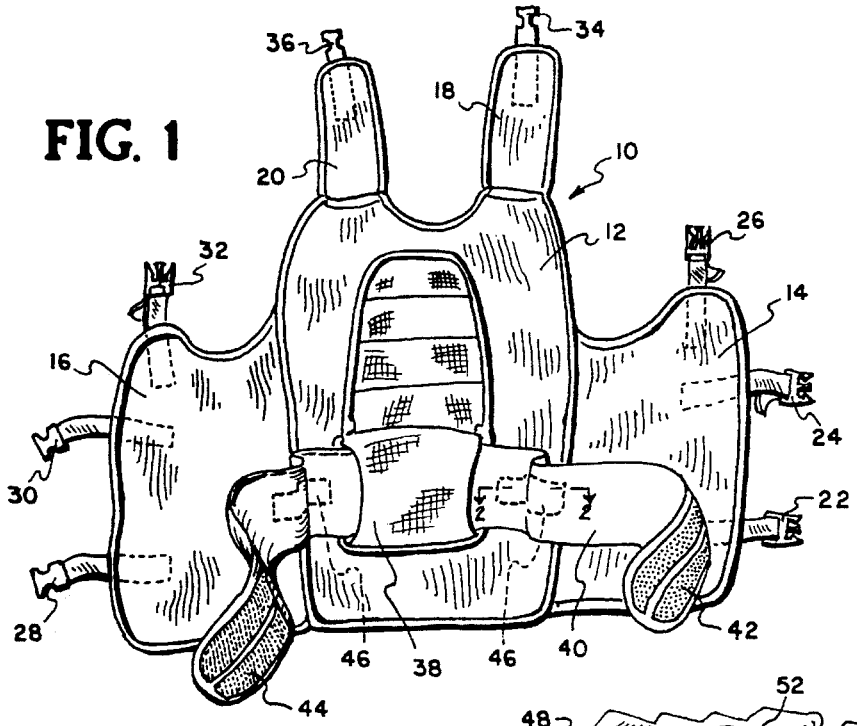
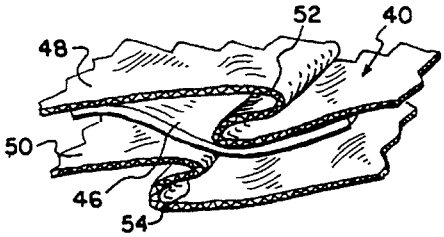
FIG. 2
FIG. 3
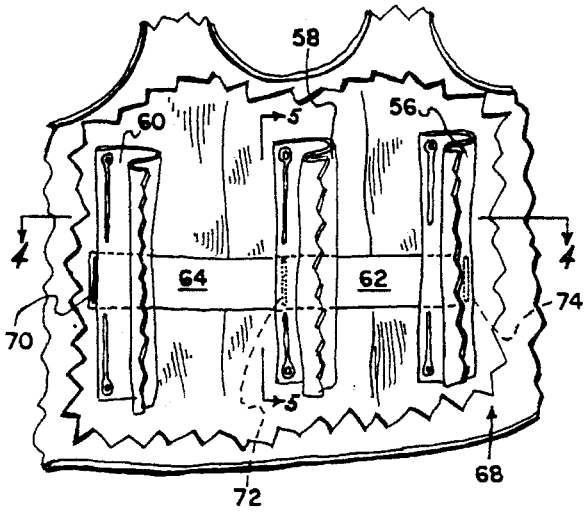
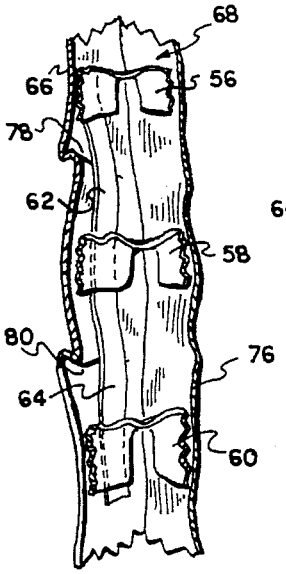
FIG. 4
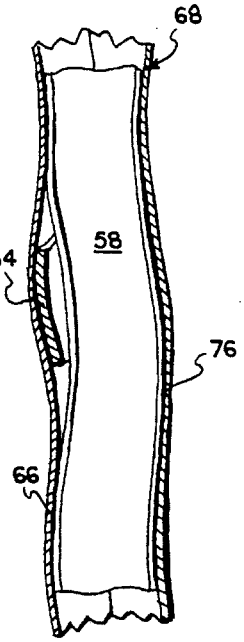
FIG. 5

PRESSURE COMPENSATING BUOYANCY JACKET

BACKGROUND OF THE INVENTION

1. Field of the Invention

The field of this invention relates to buoyancy compensating jackets to be utilized by scuba divers and more particularly to a buoyancy compensating jacket which is constructed to remain snug against the body the scuba diver not only when the diver is out of the water but even when the diver is submerged to a substantial depth.

2. Description of the Prior Art

The use of buoyancy compensating jackets by scuba divers has long been known. Typical such jackets are shown and described within a U.S. Pat. No. 5,011,334 issued Apr. 30, 1991 and U.S. Pat. No. 4,990,115 issued Feb. 5, 1991.

A buoyancy compensating jacket is used by a scuba diver to adjust his or her buoyancy during a dive. The buoyancy of the diver varies according to the depth the diver submerges. The buoyancy compensating jacket includes an inflatable bladder which the diver can inflate or deflate so that at a particular depth the weight of the diver will become neutral, that is, neither rise or sink in the water.

One problem with buoyancy compensating jackets in the prior art has been that as the diver goes deeper in the water, the jacket becomes looser. The reason for this is that as the diver submerges, the wetsuit on the body of the diver condenses or compacts. The greater the submergence, the greater the compaction. The buoyancy compensating jacket may fit tightly on the diver prior to the diver entering the water. For example, at a hundred feet down under the surface of the water, the jacket will be loose giving the effect to the diver that the jacket is several sizes too large. A loose-fitting jacket is not easy to control and uncomfortable to the diver.

In the past it has been known for the diver to adjust the jacket when the diver is submerged by making the jacket fit tighter. However, when the diver then rises to the surface of the water, the jacket will quickly become uncomfortable to the diver requiring immediate readjustment.

There is a need to incorporate within the buoyancy compensating jacket a device which automatically adjusts the tightness of the jacket on the diver.

SUMMARY OF THE INVENTION

The structure of the present invention relates to incorporating within a buoyancy compensating jacket, or incorporating within a belt which is separate from the buoyancy compensating jacket but which is to be worn with the jacket, an elastic depter compensating device which holds the jacket firmly to the body of a diver regardless of whether the diver is in air or submerged some sufficient distance below the surface of water. The elastic depth compensating device comprises a plurality of elastic strips which are connected between the inside and outside layers of the jacket or the inside and outside layers of the belt. When a diver is out of the water, the jacket or the belt is installed as tightly as possible on the body of the diver. This causes the elastic device to stretch and it is recommended that the elastic device be almost totally stretched. As the diver submerges, the jacket loosens, with this looseness being taken up (or compensated for) by the elastic device which then contracts thereby maintaining the jacket in a tight wearing condition on the diver.

The primary objective of the present invention is to construct a buoyancy compensating jacket, or a belt to be connected to a buoyancy compensating jacket, which will automatically hold the jacket in a snug condition on the torso of the diver as the diver submerges within water.

Another objective of the present invention is to construct an automatic adjusting arrangement for the buoyancy compensating jacket which can be manufactured at a relatively inexpensive price and does not utilize exterior mounted elastic ribbon material which is exposed to the elements and chaffing.

BRIEF DESCRIPTION OF THE DRAWING

FIG. 1 is an exterior view of the buoyancy compensating jacket to which is connected a belt within which is included the elastic device of the present invention;

FIG. 2 is a cross-sectional view of a portion of the belt taken along line 2—2 of FIG. 1 showing in detail one of the elastic strips incorporated in conjunction with the belt;

FIG. 3 is a view of the back wall of a buoyancy compensating jacket within which is included the elastic device of the present invention;

FIG. 4 is a cross-sectional view taken along line 4—4 of FIG. 3; and FIG. 5 is a cross-sectional view taken along line 5—5 of FIG. 3.

DETAILED DESCRIPTION OF THE SHOWN EMBODIMENT

Referring particularly to the drawing, there is shown a buoyancy compensating jacket 10 which comprises generally a back section 12 to which are attached on each side thereof side flaps 14 and 16. Connected to the upper edge of the back portion 12 are shoulder straps 18 and 20. Side flap 14 includes belt members 22, 24 and 26. Side flap 16 includes belt members 28, 30 and 32. Shoulder strap 18 includes connector 34. Shoulder strap 20 includes connector 36. When the jacket 10 is located about the body of a diver (not shown), belts 22 and 28 connect together, belts 24 and 30 connect together, connector 34 connects to belt 26 and connector 36 connects with belt 32. The buoyancy compensating jacket 10 is to be constructed of an outer layer and inner layer of fabric with an inflated bladder located interiorly thereof or an outer and inner layer of sealable material that does not require an inner bladder and is commonly referred to as a bladderless design. The basic construction of such buoyancy compensating jackets is deemed to be conventional and not specifically a part of this invention.

Referring particularly to FIGS. 1 and 2 of the drawing there is shown a modification of the back wall 12 which includes an enlarged belt loop 38. That belt loop 38 is to have conducted therethrough a wide belt 40. The belt 40 terminates at ends with one end to include a strip type of hook fastener 42 and on the opposite end including a strip type of eyelet fastener 44 (commonly sold under the trade name of VELCRO). Fasteners 42 and 44 are to be connected together in a snug manner about the torso of the diver and about the jacket 10.

Included within the belt 40 are a pair of elastic strips 46. It is to be known that there are two in number of the strips, 46 being shown in conjunction with the belt 40. However, it is considered to be within the scope of this invention that the number of the strips 46 can be increased or decreased without departing from the concept of this invention.

The belt 40 is constructed of an inner fabric layer 48 and an outer fabric layer 50. The layers 48 and 50 are to be sewn or otherwise fastened together forming a single integral structure constituting the belt 40. The elastic strips 46 are fixedly secured, as by sewing or heat sealing, to the inner layer 48 and located between the inner layer 48 and the outer layer 50. The elastic strips 46 will normally comprise some type of an elastomeric material with each of the strips 46 being stretchable. The strips 46 are sewn, heat sealed or otherwise secured in conjunction with the layer 48 so that a portion of the layer 48 forms a loop 52. This in turn causes a loop 54 to be also formed within the outer layer 50.

Noting particularly to FIG. 2 of the drawing, if an individual grasps the belt 40 at both ends and exerts a pulling force, the elastic strips 46 will stretch and when the strips 46 are in a totally stretched position, the loops 52 and 54 will be eliminated with the belt 40 forming a continuous complete structure. This is the position of the belt 40 when it is initially installed about the jacket 10 when placed on the body of the diver (not shown). When the diver submerges within the water and progresses to an ever deepening depth, the wetsuit of the diver will compact with the result that the elastic strips 46 will move toward a relaxed position which will again produce the loops 52 and 54. When the elastic strips 46 are in a completely relaxed position, the loops 52 and 54 will be in the position as shown in FIG. 2.

Referring particularly to FIGS. 3, 4 and 5, there is shown a modified structure of the present invention where instead of utilizing the belt 40 there is utilized a pair of elastic segments 62 and 64 which are fixedly mounted on the inside surface of the inside fabric layer 66 of the front or back wall 68 of the buoyancy compensating jacket. Strips 62 and 64 may be formed from one continuous elastic strip which is attached at multiple positions to the inside fabric layer 66 along its entire length. These positions are shown as attachment strip 70 in conjunction with divider 60, attachment strip 72 in conjunction with divider strip 58 and attachment strip 74 in conjunction with divider strip 56.

Divider strips 56, 58 and 60 are attached between inside wall 66 and the outside wall 76 to prevent the inflating bladder of the jacket from ballooning. When the strips 62 and 64 are in a relaxed state, loops 78 and 80 are formed within the inside wall fabric layer 66 with appropriate excess material being provided in outside wall 76. When the jacket is tightly installed about the wetsuit of the diver, the strips 62 and 64 will be stretched and the loops 78 and 80 will be eliminated.

The attachment strips 70, 72 and 74 can be produced by sewing or heat sealing or other normal type of attachment arrangement. Similar attachment arrangements are to be utilized in connection of the divider walls 56, 58 and 60 in between the fabric walls 66 and 68.

I claim:

1. In combination with a pressure compensating buoyancy jacket usable by a scuba diver when submerging in water, said jacket being constructed of an inner layer and an outer layer, said inner layer and said outer layer overlapping each other, said jacket having a confining volume with the torso of the diver to be located within said confining volume, a pressure compensating device comprising:

elastic means mounted between said inner layer and said outer layer, said elastic means being movable between a relaxed position and a totally stretched position, with said elastic means being in said relaxed position said confining volume being of minimum size and said inner layer forming a first loop of material at said elastic means and said outer layer forming a second loop of material at said elastic means, with said elastic means being in said totally stretched position said confining volume being of maximum size with said first loop and said second loop being eliminated with said inner layer and said outer layer forming a continuous complete structure, whereby when said jacket is worn by a diver outside the water said jacket is to be worn with said elastic means at or near said totally stretched position, when the diver submerges to a sufficient depth the water pressure will cause a wetsuit of the diver to condense tending to cause the jacket to become loose on the torso of the diver but said elastic means moves toward said relaxed position which causes said jacket to remain tight on the torso of the diver.

2. The combination as defined in claim 1 wherein:

said elastic means comprising a plurality of spaced apart elastic strips.

* * * * *